United States Patent [19]

Povio et al.

[11] Patent Number: 4,494,744

[45] Date of Patent: Jan. 22, 1985

[54] SHEET FEEDING AND SEPARATING APPARATUS EMPLOYING A MULTIPLE PIECE ENTRANCE GUIDE.

[75] Inventors: Raymond A. Povio, Pittsford; Robert P. Rebres, Fairport, both of N.Y.

[73] Assignee: Xerox Corporation, Stamford, Conn.

[21] Appl. No.: 421,018

[22] Filed: Sep. 21, 1982

[51] Int. Cl.[3] ..... B65H 3/04

[52] U.S. Cl. ..... 271/34; 271/125

[58] Field of Search ..... 271/34, 35, 122, 125, 271/121, 124, 37, 38

[56] References Cited

U.S. PATENT DOCUMENTS

| | | | |
|---|---|---|---|
| 3,469,834 | 9/1979 | Stange et al. | 271/10 |
| 3,768,803 | 10/1973 | Stange | 271/34 |
| 3,790,159 | 2/1974 | Hatzmann et al. | 271/35 |
| 3,995,952 | 12/1976 | Schoppe | 355/3 R |
| 4,033,578 | 7/1977 | Taylor et al. | 271/34 |
| 4,192,497 | 3/1980 | Perun et al. | 271/18 |
| 4,203,586 | 5/1980 | Hoyer | 271/34 |
| 4,312,503 | 1/1982 | Saxinger et al. | 271/34 |

FOREIGN PATENT DOCUMENTS

| | | |
|---|---|---|
| 2011477 | 1/1980 | Fed. Rep. of Germany . |
| 57-69481 | 4/1982 | Japan . |

*Primary Examiner*—Bruce H. Stoner, Jr.
*Assistant Examiner*—John A. Carroll
*Attorney, Agent, or Firm*—William A. Henry, II

[57] ABSTRACT

A sheet feeding and separating apparatus includes a multiple piece entrance guide located between a stack from which sheets are to be fed and a retard nip. The guide includes a polycarbonate base member and a high friction urethane retard member. The urethane is ground on the leading edge to an exact angle to promote shingling of sheets and the breaking up of slugs prior to entering the retard nip.

3 Claims, 5 Drawing Figures

SHEET FEEDING AND SEPARATING APPARATUS EMPLOYING A MULTIPLE PIECE ENTRANCE GUIDE

This invention relates to a sheet feeding and separating apparatus for feeding individual sheets from a stack, and more particularly to sheet feeding and separating apparatus that employs an entrance guide located between the sheet stack and retard separator in order to enhance the feeding of a wide variety of sheets.

A major problem associated with sheet feed devices is in feeding papers of varying weights and surface characteristics. With the advent of high speed reproduction machines, the need for sheet feeders to handle a wide variety of sheets without misfeed or multifeed is paramount. However, most sheet feed devices are designed specifically for a particular type or weight of paper having known characteristics. Thus, for example, for feeding virgin sheets upon which copies are to be made into a reproduction machine, the sheet feeders are usually designed specifically for a certain copy paper characteristic. However, in practice, the machine will be exposed to a wide variety of sheets ranging from extremely heavy paper all the way to onion skin. If a feeder is designed to handle the lightest weight paper that may be encountered, in all probability it will not feed heavy stock paper. At the other extreme, if a feeder is designed to handle heavy weight paper there is a possibility that the feeder would severely mulitlate light weight paper such as onion skin.

Among problems encountered in feeding lightweight sheets in retard feeders is buckling of sheets between the feed head and retard station and sheets curling behind the retard station.

The present invention overcomes the above-mentioned problems and comprises a multiple piece entrance guide used in a retard feeder as both a support member and sheet separation gate.

A preferred feature of the present invention is characterized by the use of a multiple piece entrance guide positioned between a sheet feeding member mounted in feeding engagement at an edge of a stack of sheets and a retard nip. The guide consists of a polycarbonate base member and a high friction urethane retard member. The urethane is ground on the leading edge to an exact angle to promote the breaking up of slugs of sheets prior to entering the retard nip. The polycarbonate member provides total support for sheets from the stack to the retard nip.

Other features and aspects of the present invention will be apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
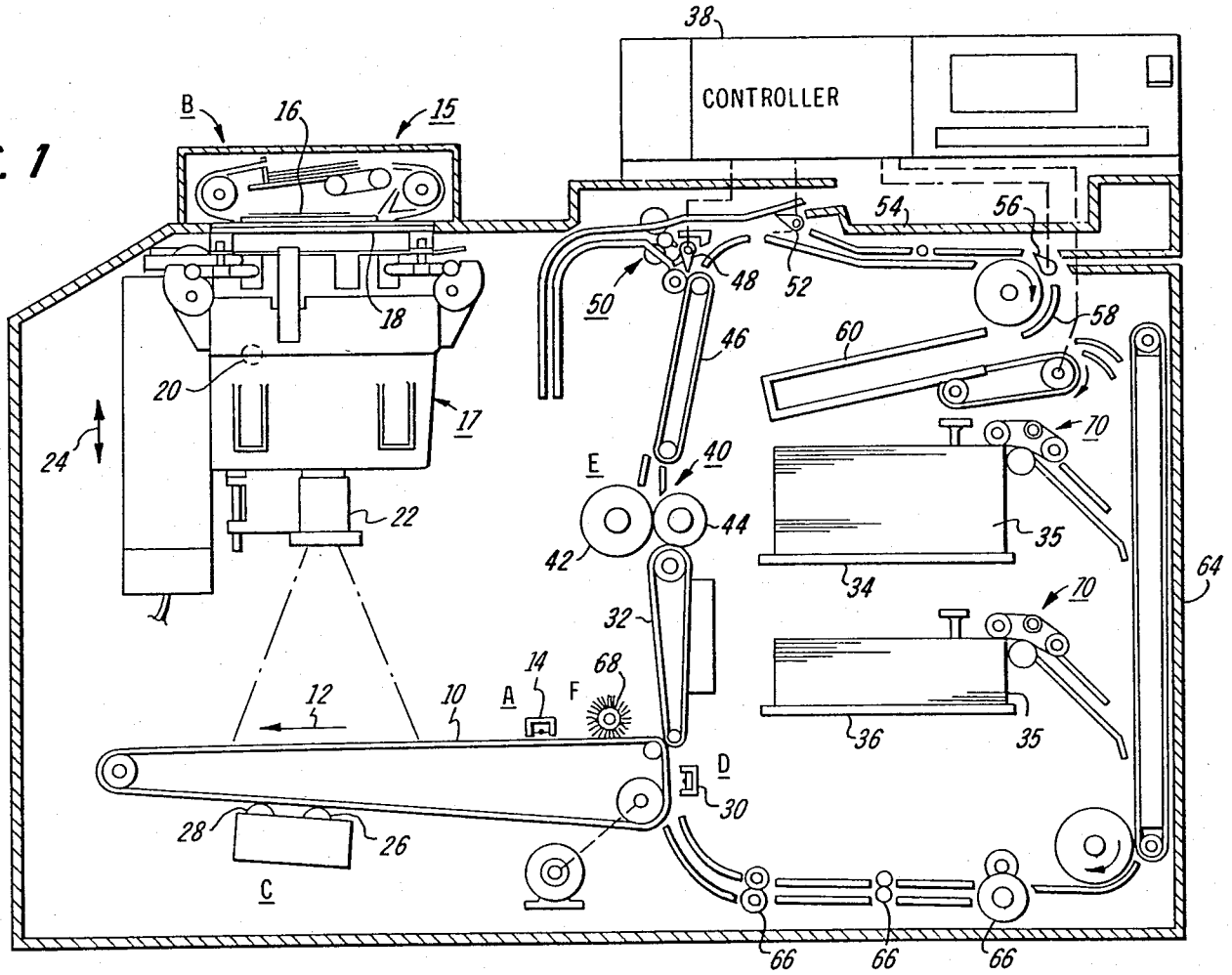
FIG. 1 is a schematic elevational view showing an electrophotographic printing machine employing the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the sheet feeding and separating apparatus of the present invention therein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit, indicated generally by the reference numeral 15, positions original document 16 facedown over exposure system 17. The exposure system, indicated generally by reference numeral 17 includes lamp 20 which illuminates document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the informational areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portions of the photoconductive surface of belt 10.

Document handling unit 15 sequentially feeds documents from a stack of documents placed by the operator in a normal forward collated order in a document stacking and holding tray. The documents are fed from the holding tray, in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured.

While a document handling unit has been described, one skilled in the art will appreciate that the size of the original document may be measured at the platen rather than in the document handling unit. This is required for a printing machine which does not include a document handling unit.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into contact with the toner powder image. Transfer station D includes a corona generating device 30 which sprays ions onto the backside of the copy sheet. This attracts the toner powder image from the photoconductive surface of belt 10 to the sheet. After transfer, conveyor 32 advances the sheet to fusing station E.

The copy sheets are fed from a selected one of trays 34 or 36 to transfer station D. Each of these trays sense the size of the copy sheet and send an electrical signal indicative thereof to a microprocessor within controller 38. Similarly, the holding tray of document handling unit 15 includes switches thereon which detect the size of the original document and generate an electrical signal indicative thereof which is transmitted also to a microprocessor controller 38.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, conveyor 46 transports the sheets to gate 48 which functions as an inverter selector. Depending upon the position of gate 48, the copy sheets will either be deflected into a sheet inverter 50 or bypass sheet inverter 50 and be fed directly onto a second decision gate 52. Thus, copy sheets which bypass inverter 50 turn a 90° corner in the sheet path before reaching gate 52. Gate 48 directs the sheets into a face up orientation so that the imaged side which has been transferred and fused is face up. If inverter path 50 is selected, the opposite is true, i.e., the last printed face is facedown. Second decision gate 52 deflects the sheet directly into an output tray 54 or deflects the sheet into a transport path which carries in on without inversion to a third decision gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60 when gate 56 so directs. Duplex tray 60 provides intermediate or buffer storage for those sheets which have been printed on one side and on which an image will be subsequently printed on the side opposed thereto, i.e., the copy sheets being duplexed. Due to the sheet inverting by rollers 58, these buffer set sheets are stacked in duplex tray 60 facedown. They are stacked in duplex tray 60 on top of one another in the order in which they are copied.

In order to complete duplex copying, the previously simplexed sheets in tray 60 are fed seriatim by bottom feeder 62 back to transfer station D for transfer of the toner powder image to the opposed side of the sheet. Conveyers 64 and 66 advance the sheet along a path which produces an inversion thereof. However, inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to be stacked in tray 54 for subsequent removal by the printing machine operator.

Returning now to the operation of the printing machine, invariably after the copy sheet is separated from the photoconductive surface of belt 10, some residual particles remain adhering to belt 10. These residual particles are removed from the photoconductive surface thereof at cleaning station F. Cleaning station F includes a rotatably mounted fibrous brush 68 in contact with the photoconductive surface of belt 10. These particles are cleaned from the photoconductive surface of belt 10 by the rotation of brush 68 in contact therewith. Subsequent to cleaning, a discharge lamp (not shown) floods the photoconductive surface with light to dissipate any residual electrostatic charge remaining thereon prior to the charging thereof for the next successive imaging cycle.

Figure 2:
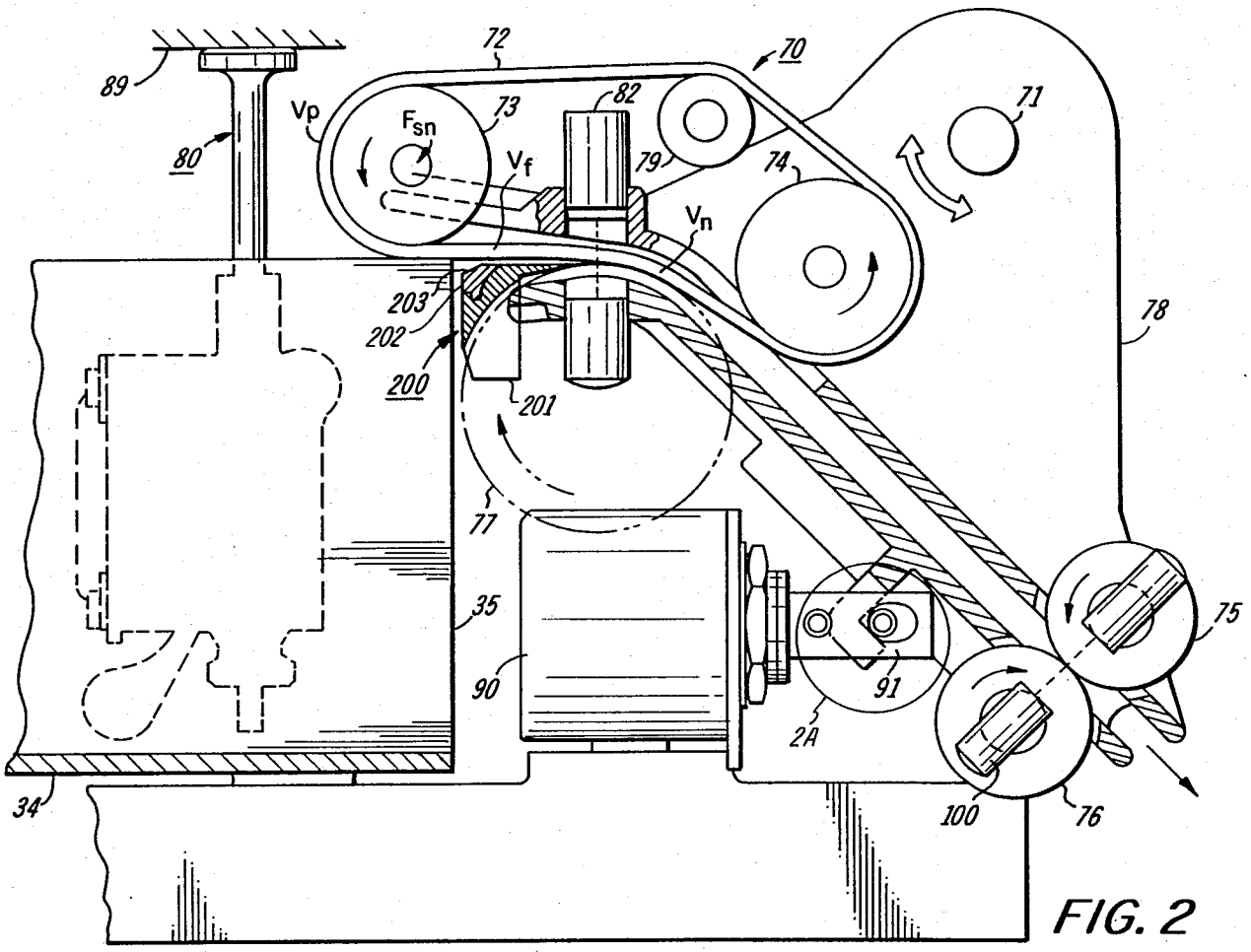
FIG. 2 is a schematic elevational view depicting the entrance guide of the present invention used in the sheet feeding and separating apparatus of the FIG. 1 printing machine.

Turning now to an aspect of the present invention, a multiple piece entrance guide 200 is disclosed in FIG. 2 as an integral part of retard feed head mechanism 70. The guide 200 consists of a polycarbonate base member 201 and a high friction urethane retard member 202. The multiple piece entrance guide is used as both a support and sheet gate and just touches the feed belt. Urethane member 202 is ground or beveled on the leading edge 203 to an exact angle to promote breaking up of sheet slugs prior to entering the retard zone.

The bevel angle for various entrance guides to paper friction coefficients are as follows:

| Entrance Guide Material to Paper Coefficient | Bevel Angle |
|---|---|
| 0.3 | 57° |
| 0.9 | 32° |
| 1.0 | 29° |
| 1.2 | 23° |

Further, the top surface of the guide which also has a high friction surface can perform additional sheet separation as long as the coefficient of friction of paper to guide is greater than the coefficient of friction of paper to paper. This feature acting in concert with stack force relief employed in feed head mechanism 70 allows the feed head mechanism to process a wide variety of sheets. It should be understood that the guide friction coefficient against paper must be to the feed belt 72 coefficient of friction against paper which is unlike the rotating retard 77 coefficient of friction against paper. Polycarbonate member 201 is also an important factor in feeder 70 being able to handle lightweight sheets. By being able to mold a very thin section of approximately 0.25 mm, sheets are supported all the way from sheet stack 35 to retard roll 77. This longer lead-in of the paper from the stack to the retard roll gives the benefit of control of the paper all the way to the retard zone. This total support of the paper is necessary to effectively handle 13 lb. and 16 lb. sheets.

There are numerous advantages obtained by the use of the entrance guide of the present invention over prior retard feeder systems. For example, sheet buckling is minimized due to the support of the sheets between the paper stack and the retard nip entrance. Further, the guide contributes to the reducing of the maximum number of sheets that reach the retard nip to a manageable number, a number that can be separated by the retard nip. Also, the guide serves to avoid stubbing curled sheets and to minimize misfeeding. The guide also avoids contributing to multifeed failures.

With specific reference to FIG. 2, a feed head mechanism 70 is shown which pivots about the feed head pivot point 71. The feed head in this instance is intended to include everything shown with the exception of sensor 80, paper stack 35 and abutment 89. The dynamic normal force is shown as $F_{sn}$. This is a force applied to the paper stack 35 by feed belt 72 due to the feed head balancing around pivot point 71 and the effect of drive torques supplied to the feed head through the pivot point. Belt drives (not shown) transfer power to the feed belt 72 and take-away rolls 75 and 76. The separation capability of the guide is enhanced by controlling the downward force component of the feed belt against the top surface of the guide. This force component is controlled by having feed belt 72 comprise a composition of sufficient tension and bending, stiffness that shingling of sheets at the guide occurs as desired.

Figure 3A:
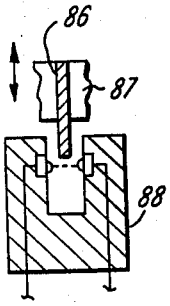
FIG. 3A is a partial side view of the photocell arrangement of the sensor shown in FIG. 3.
Figure 3:
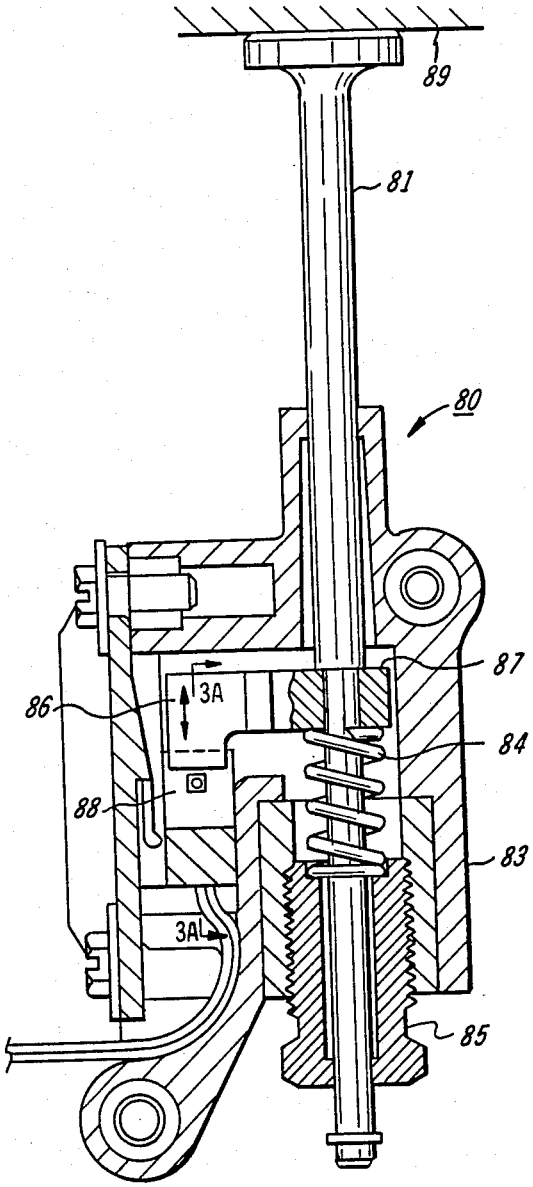
FIG. 3 is an elevational view of a stack normal force sensor shown in FIG. 1.

In order for feed head mechanism 70 to be able to feed a wide variety of sheets, in addition to entrance guide 200, an initial normal force must be placed on the stack of sheets 35 by feed belt 72 with the normal force being controlled by a device that allows a wide range of settings within a tight span without binding tendencies. The device is shown in FIGS. 3 and 3A as stack height sensor 80. This sensor with stack force relief sensor 82 combines to give feed head 70 automatic stack force adjustments.

When paper is inserted into either paper tray 34 or 36 and the access door is closed, a motor (not shown) is actuated to raise paper stack 35 which is supported on trays 35 or 36 mounted on an elevator (not shown) until plunger 81 of sensor 80 contacts abutment 89. The sensor is adjusted such that the stack normal force of the idler and belt against the stack 35 is 0.5 lbs. when the elevator motor is stopped. The sensor comprises, as shown in FIG. 3, housing 83 for a plunger 81 with drag forces on the plunger being controlled by clearances, part finish and material selection. The plunger 81 is in turn loaded by a compression spring 84 which is made adjustable by screw or bushing 85 which grounds the free end of the spring. A flag 86 mounted on a shoulder 87 which is adapted to move with plunger 81 and as it moves in a linear direction, blocks and unblocks an optoelectrical sensor 88 as shown in FIG. 3A. This in turn signals the logic in controller 38 as to when the elevator and tray must be indexed to maintain proper feeding. This sensor works in conjunction with stack force relief mechanism 70 to provide an automatic two step system of normal force adjustment for the friction retard feeders as shown in FIG. 2.

The normal force between the feeding component and the stack is a critical parameter. If $F_{sn}$ is too large, multifeeding will occur. If $F_{sn}$ is too small, misfeeding will occur. In some feeders, such as the present, a sheet or sometimes a group of sheets are fed to a separation station. If the sheets are in a group or slugs, they are shingled by guide 200. Once the sheet or sheets are in the separation station, stack normal force drive is no longer necessary. At this point it is advantageous to reduce the stack normal force in order to reduce the tendency to drive a second sheet through the separation station formed between feed belt 72 and retard roll 77. To accomplish this end result, a sensor 82 is shown in FIG. 2 which senses the presence of a sheet in the separation station and causes the stack normal force to be reduced through means to be described hereinafter. While feed belt 72 and retard roll 77 are shown in the disclosed embodiment of FIG. 2, it should be understood that a different feed means, such as, a roll, paddle wheel, etc., could replace the belt and be used together with a dual roll retard nip if one desired.

Figure 2A:
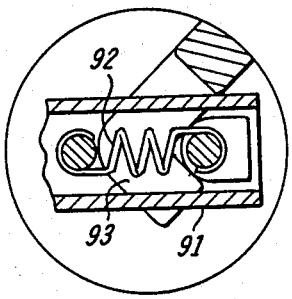
FIG. 2A is a schematic elevational view illustrating the spring employed in a solenoid member used to pivot the sheet feeding and separating apparatus of FIG. 2.

In operation, retard separator mechanism 70 which is mounted on a frame 78 pivots about axis 71 as required. When stack force relief sensor 82 detects the lead edge of a sheet at the retard nip formed between belt 72 and retard roller 77, controller 38 actuates solenoid 90 which through retracting plunger 91 pivots frame 78 about axis 71 and lifts the frame slightly. As shown in FIG. 2A, a balancing solenoid plunger 91 is in contact with a preloaded, low rate, coil spring module 92. When the solenoid is actuated, the plunger begins to move as soon as its magnetic field has adequately developed. The stack normal could be reduced to zero or lifted completely off the stack if desired, however, for optimum results, the stack normal force is reduced from 0.5 lb. to 0.1 lb. The force in the retard nip will cause the belt to drive the first sheet through the nip and into the take-away rolls 75 and 76. Because the stack normal force has been reduced, i.e., stack force relief has been applied, it should not contribute enough drive force to the second sheet to drive it through the nip, thus reducing the probability of a multifeed. Conversely, if the stack normal force has been reduced and sensor 82 does not detect a sheet every 0.3 sec., the controller will deactuate solenoid 90 causing the separator mechanism to assume its original position and thereby increasing the stack normal force to 0.5 lb. in order to feed a sheet from the stack, i.e., the stack force is enhanced. The term sheet is used herein to mean substrates of any kind.

This feeder employs independent drives for the feed belt 72 through drive roll 74 and take-away rolls 75 and 76 through drive roll 75. With roll 75 as the drive roll, one clutch is used to drive the feed belt and one clutch is to drive the take-away rolls. A wait sensor 100 is stationed at the take-away roll, i.e., away from the retard roll nip. An early feed belt restart logic is used with this independent drive system. The logic restarts the feed belt (after wait time has elapsed) as soon as there is no paper at the stack normal force relief sensor 82 or as soon as there is no paper at the wait sensor 100, whichever occurs first. The wait sensor is also used as a jam detector.

The paper feeders 34 and 36 have a drag brake controlled retard roll 77. The retard brake torque and other feed head critical parameters are selected so that with one sheet of paper through the retard nip the retard roll rotates in the feed direction and with two sheets of paper through the retard nip the roll is fixed.

When paper is present at stack force relief sensor 82 the $F_{sn}$ value is controlled to a low value. When no paper is present at sensor 82 the $F_{sn}$ value is increased. The high value of $F_{sn}$ is defined so that the most difficult paper will feed reliably, i.e., not misfeed. The low value of $F_{sn}$ is defined so that the lightest weight sheets will not be damaged with stack force relief acting. The high and low values of $F_{sn}$ are independent. Sheet buckling could occur whenever the paper is being driven by both the pick off idler 73 and feed retard nip 72, 77. However, whenever that condition exists there is paper present at sensor 82 and the feed belt to sheet coupling at the pick off idler 77 is inadequate to cause lightweight sheet buckling, therefore, light weight sheet buckling will not occur.

In conclusion, it should be apparent from the foregoing that a retard feeder has been disclosed that includes a multiple piece entrance guide as a critical element thereof. The guide is essential to the feeder's capability of breaking up and shingling slugs of sheets before they reach the retard nip and of feeding a wide variety of sheets and comprises an elastomer covering on the paper guiding surface of the guide and a polycarbonate base member. The elastomer controls the friction to avoid providing extra driving force to a second sheet. Also, the guide is placed very close to the retard member in order to provide complete support for a sheet from the stack to the retard nip to thereby avoid the curling of lightweight sheets behind the retard roll.

What is claimed is:

1. A sheet feeding and separating apparatus for feeding and separating sheets individually from a stack of sheets, comprising:

tray means for holding the stack of sheets, said tray means includes elevator means that lifts any sheet to be fed from said tray means to a feeding position above the confines of said tray means so that the sheets in the stack are initially unobstructed as they are fed from the stack;

endless feed belt means mounted in sheet feeding engagement with the top of the stack of sheets and applying a normal force thereto;

said feed belt means being rotatably mounted between spaced supports to provide a deformable unsupported section therebetween;

a retard roll having a curvilinear portion thereof deformably engaging said feed belt means to form a nip therebetween for separating any overlapped sheets reaching the nip; and an integrally molded stationary multiple piece entrance guide positioned between said retard roll and said tray means such that said entrance guide is the first obstruction sheets being fed by said feed belt means encounter in route to the nip formed between said retard roll and said feed belt means, said entrance guide includes a high friction urethane first portion with a beveled edge that serves to shingle slugs of sheets and a polycarbonate second portion that supports said first portion, said polycarbonate second portion having an elongated third portion that is cantilevered, said elongated third portion includes an upper surface that terminates at a sharp edge and extends to a position immediately adjacent said curvilinear portion of said retard roll and works in conjunction with an upper surface of said high frictional urethane first portion to support sheets the entire distance from the stack into said curvilinear portion of said retard roll to prevent lightweight sheets from causing jams at the nip formed between said retard roll and said feed belt means.

2. The apparatus of claim 1, wherein said elongated third portion of said polycarbonate second portion has a thickness of about 0.25 mm.

3. The apparatus of claim 1, wherein the beveled edge of said high friction urethane first portion comprises an angle of between 23 and 57 degrees.

* * * * *